United States Patent [19]

Jesse et al.

Best Available Copy

[11] 4,297,522

[45] Oct. 27, 1981

[54] CABLE SHIELD

[75] Inventors: Harold W. Jesse, Amherst; Peter M. Jones, Sandown, both of N.H.

[73] Assignee: TME, Inc., Hudson, N.H.

[21] Appl. No.: 73,197

[22] Filed: Sep. 7, 1979

[51] Int. Cl.[3] ..... H01B 11/10

[52] U.S. Cl. ..... 174/36; 174/68 C; 174/102 R; 174/117 FF

[58] Field of Search ..... 174/36, 68 C, 117 F, 174/117 FF, 102 R, 102 SC, 102 C, 32

[56] References Cited

U.S. PATENT DOCUMENTS

| | | | |
|---|---|---|---|
| 1,106,103 | 8/1914 | Lutz | 174/68 C |
| 1,746,299 | 2/1930 | Berry | 174/102 D |
| 2,960,561 | 11/1960 | Plummer | 174/68 C X |
| 3,576,723 | 4/1971 | Amgele | 174/117 FF |
| 3,576,941 | 5/1971 | Colglazier | 174/117 FF |

FOREIGN PATENT DOCUMENTS

| | | | |
|---|---|---|---|
| 428175 | 5/1935 | United Kingdom | 174/102 |

OTHER PUBLICATIONS

Republic Steel Advertisement, Electrical Construction and Maintenance, Dec. 1972 at p. 8.

*Primary Examiner*—Richard R. Kucia

*Attorney, Agent, or Firm*—Sewall P. Bronstein; Donald Brown

[57] ABSTRACT

A flat cable shielding device comprises a metal foil sleeve formed of an upper and a lower length of conductive metal foil. To aid the insertion of flat cable into the shielding device, a low-friction inside surface is provided on the inside surface of the metal foil sleeve. The outside of metal foil sleeve is covered with an electrically insulating film, to provide wear and scuff protection. Both the low-friction inside surface and other outer coating are coupled to the metal foil sleeve preferably using adhesive. Good electrical connections can be made easily to the shielding device which can be used as a floating ground or can be grounded to a common system ground as desired.

6 Claims, 6 Drawing Figures

CABLE SHIELD

BACKGROUND OF THE INVENTION

This invention relates to electromagnetic radiation shields and more particularly, to an electromagnetic radiation shielding device particularly suitable for shielding flat cable. The shielding device of the present invention provides novel means for making good electrical connection to it and may be used as a floating ground or can be easily connected to a common system ground.

Current carrying cables often require an insulating shield effective to prevent electromagnetic energy radiation therefrom or from effecting same. As electrons move from one place to another, a field of electromagnetic energy is created which radiates outwardly from the point of generation. This electromagnetic energy influences the electrons in any conducting material within its field. It is important, therefore, to be able to contain the electromagnetic field within its source, and to prevent spurious electromagnetic energy from affecting other systems by permeating normal electrical insulation. Shielding of electromagnetic energy radiation may be accomplished by enclosing the current carrying cable within a continuously conductive shield. It is desirable that the shield not have breaks or discontinuities through which electromagnetic energy can leak since this would result in the loss of shielding effectiveness.

A suitable shielding device for current carrying cable which is flat cable must be of sufficient dimensions to enable the flat cable to be inserted into it. It is desirable that a shielding device for such flat cable, even though providing a continuously conductive enclosure of adequate strength along the length of the flat cable, nevertheless be lightweight and flexible. Since many applications require the use of current carrying flat cable having a given degree of flexibility, the flat cable shielding device should likewise have sufficient flexibility to enable its use in such applications. Accordingly, a flat cable shielding device should be as lightweight and as flexible as possible to enable its use in a broad range of applications. The shielding device must however, also have sufficient strength to withstand the demands or ordinary use.

While a flat cable shielding device could be formed integrally with the cable, it is desirable that the shielding device be distinct from the flat cable itself. In this manner, the shielding device can be used only where necessary and can be employed in conjunction with flat cables having differing dimensions.

The shielding device itself must often be insulated so as to be electrically isolated from its environment. Nevertheless, it is desirable to provide a flat cable shielding device which can be used as a floating ground or which can be grounded to a common system ground. Therefore, it is desirable that the shielding device be electrically insulated and yet provide a means by which electrical connections can easily be made to it. With respect to a shielding device for flat cable, it is desirable to make good positive electrical connections to the shielding device without adversely affecting the effectiveness of the shielding of electromagnetic energy and without damaging or otherwise interfering with the current carrying flat cable. It is an important feature of the flat cable shielding device of the present invention that it provides means for easily making good electrical connections to it without significantly adversely affecting its effectiveness and without interfering with the flat cable within it.

An additional significant problem is seen to exist in the degree of difficulty encountered when inserting the current carrying cable into the shielding device. This problem is seen to be especially acute with respect to shielding devices for flat cable. Where the shielding device is potentially of great length and since it is preferrably flexible and may necessarily become dilated an/or curved or uncurved during the insertion of the flat cable, it may require considerable force to insert the flat cable into the shielding device. However, the flat cable, especially for example, if it is wide and thin cable, may be unable to transmit sufficient force to the leading edge. Rather, it may buckle or bend.

Accordingly, it is an object of the present invention to provide a flat cable shielding device into which flat cable may be easily inserted. Even, for example, flat cable which is wide and thin may be easily inserted into the flat cable shielding device of the present invention.

Another object of the present invention is to provide a flat cable shielding device which provides means for easily making good electrical connections without significantly adversely affecting the effectiveness of the shielding of electromagnetic energy and without interfering with or damaging the current carrying flat cable.

Another object of the present invention is to provide a flat cable shielding device which can be easily and used as a floating ground on which can be easily grounded to a common system ground. Another objective of the present invention is to provide a flat cable shielding device which is electrically insulated from its environment but to which good electrical connections can easily be made.

Another object of the present invention is to provide a flat cable shielding device providing a continuously conductive enclosure along the length of the flat cable. It is a further object of the present invention to provide such a shielding device which is also lightweight and flexible. It is a further object to provide such a shielding device which also ha sufficient strength to withstand the demands of ordinary use.

These and other objects are achieved in accordance with the following description of the present invention.

SUMMARY OF THE INVENTION

The above objectives are accomplished by the present invention which provides a novel electromagnetic radiation shielding device particularly suitable for flat cable. The shielding device comprises a sleeve comprises of an upper and a lower length of conductive metal foil, the lower length being folded over the upper length of foil along both longitudinal edges thereof so as to form a flange and provide continuous metal-to-metal contact along both eges of the metal foil sleeve. If desired electrically conductive adhesive may be used to better connect the upper and lower lengths of foil or alternative crimping of the overlapping metal foils may be used for the same purpose. The inside surface of the sleeve preferably carries a plastic layer to provide a low friction surface to enable the flat cable to be more easily inserted into the shielding device. The metal foil sleeve is covered with an exterior electrically insulating plastic film. Preferrably, the thin plastic film inside and electrically insulating plastic covering outside are adhesively bonded to the metal foil sleeve.

Flat cable inserted into the flat cable shielding device of the present invention is shielded against electromagnetic radiation and the shielding device itself is electrically insulated from its environment.

Good electrical connections can easily be made to the shielding device of the present invention which can be used as a floating ground or be grounded to a common system ground as desired.

DETAILED DESCRIPTION OF THE INVENTION

Figure 1:
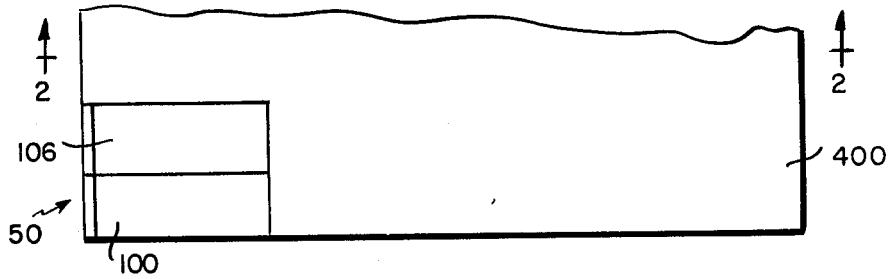
FIG. 1 is a top view of the shielding device wherein a portion of one flange (folded over portion) is folded back to expose the metal for grounding.

Reference should now be had to FIGS. 1 an 2 for a description of the preferred embodiment of the flat cable shielding device according to this invention. In the figures, the shielding device is shown generally as 50. It includes a first length of metal foil, 100, referred to hereinafter as the upper metal foil. This upper metal foil comprises a conductive metal foil, preferrably copper or aluminum. More preferrably the upper metal foil is 1100/0 Aluminum foil of about from 1 to 3 mils thick. Most preferably it is about 2 mils thick.

A second length of metal foil, 105, referred to hereinafter as the lower metal foil, faces the upper metal foil, 100, but is of greater width and preferably extends an equal distance on either side of the upper metal foil. The extended portions of the lower metal foil 105 are folded over the upper metal foil 100 along both longitudinal edges thereof to form flanges (folded over portions) 106 and 107 to provide continuous metal-to-metal contact between the upper and lower metal foils. The flanges are each preferably about from 0.1 to 1.5 inches wide, more preferably about 0.75 inches wide along each side of the shielding device. The lower metal foil 105 is comprised of a conductive metal foil as specified for the upper metal foil. Together, the upper and lower conductive metal foils 100 and 105 comprise a sleeve which, with the metal-to-metal contact provided by the flanges 106 and 107 along each side of the shielding device, provides a continuous, unbroken shield of conductive material for a flat cable inserted into shield 50, in the space 700 (see FIG. 1.).

The inside surface of both the upper and lower metal foils 100 and 105 respective are coupled to a thin plastic film 200 to provide a low-fraction inside surface. However, those portions of the lower metal foil 105 which make contact with the upper metal foil, 100, are not coupled to or covered by such thin film but rather are left bare so that metal-to-metal contact can be made when these portions are folded over the upper metal foil to form the flanges. The plastic film 200, comprises a material suitable to provide a low-friction surface to aid insertion of the flat cable into the metal foil sleeve of the shielding device. Preferably the thin plastic film comprises a polyester material, more preferably Mylar® of about from 0.001 to 0.0002 mils thick, most preferably about 0.5 mils thick.

The thin plastic film 200, is preferably coupled to the metal foil with a first adhesive layer 300, of a thickness sufficient to provide a secure adhesive bond. The adhesive is most preferably ethylene acrylic acid copolymer adhesive of approximately 1 mil thickness. Other suitable adhesives would be well known in the art.

The outer surface of the metal foil sleeve is preferably coated with an insulating film (layer), 400, comprised of any suitable, flexible, electrically insulating material such as are well known to those skilled in the art. Preferably the insulating film is comprised of polyvinyl chloride or polyvinylidene fluoride and most preferably of polyvinylidene fluoride, for example Tedlar® of about 1 mil thickness; however this may vary depending on the environment in which the shield is to be used.

The insulating film can provide not only electrical insulation of the shielding device but can also provide scuff and wear protection of both the shielding device and the enclosed flat cable. Preferably, it is bonded to the outer surface of the metal foil sleeve by a second adhesive layer 500, which may comprise the same adhesive as specified for the first adhesive layer 300. Most preferaby it comprises a layer of ethylene acrylic acid copolymer adhesive of about 2 mil thickness. Additionally if desired to effect more shielding any electrically conductive adhesive of the types well known in the art may be used as the adhesive layer 300 or 500. The coupling is accomplished using heat and pressure according to methods well known in the art and further serves to tightly maintain the metal-to-metal contact in the flange. Where the insulating film is formed of two lengths of insulating material, each being applied to one outside surface of the metal foil sleeve, the second adhesive layer preferably also provides a film-to-film bond between these two lengths of insulating material at the edges of the metal foil sleeve.

The flat cable shielding device of the present invention provides improved means of making a ground connection and can be used as a floating ground or can be grounded to a common system ground in accordance therewith. A good electrical connection to the shielding device according to the present invention can be made by first folding back a section of the overlapping lower metal foil, 105, as the flange 106 is depicted in FIG. 1, this will expose a portion of the surface of both the upper and lower metal foil. This can easily be accomplished by cutting through the metal foil sleeve along the outer edge of the flange. The overlapping metal is then folded back and a ground connection made to the exposed metal. The ground connection can be made by any suitable means, preferably by a solder connection, a welded connection, or by mechanically affixing with a screw or rivet.

Figure 3:
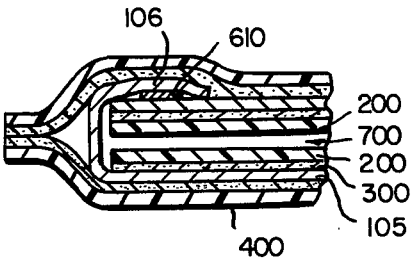
FIG. 3 is a sectional view of the shielding device showing an alternative means suitable for providing a ground connection according to the present invention.
Figure 4:
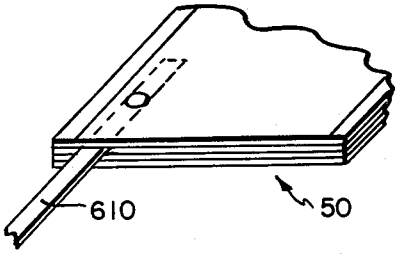
FIG. 4 is a top view partially broken away showing the shielding device with ground connection shown in FIG. 3.

Reference should now be had to FIGS. 3 and 4 which show an alternative method for providing a good electrical connection to the shielding device of the present invention. According to this method, an electrically conductive wire, 610, preferably a flat wire, is positioned between the one metal foil flange 106 and the upper foil 100. The wire should extend longitudinally into the flange a sufficient distance to permit it to be affixed therein by an suitable manner, preferably by a crimp connection, or by a rivet or screw through the shielding device and flat wire, or by a weld connection. The wire should extend from the shielding device sufficiently to provide convenient access to a ground connection point. FIG. 4 shows a flat wire suitably affixed by a rivet 611 to the shielding device in the flange and extending from the end thereof to provide access to a ground connection point.

Figure 2:
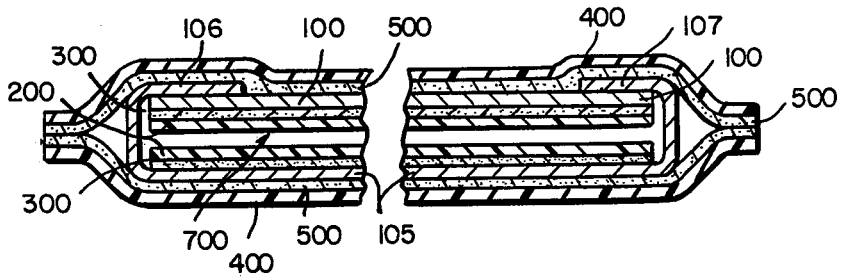
FIG. 2 is a sectional view of the flat cable shielding device according to the present invention taken along line 2—2 in FIG. 1.
Figure 5:
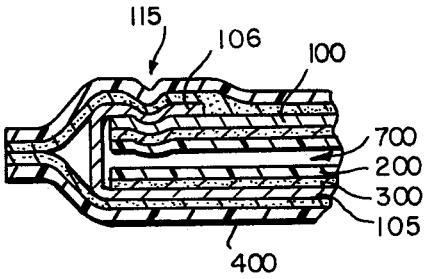
FIG. 5 is an enlarged view of the flange section of the flat cable shielding device showing the use having a longitudinal crimp in the flange to effect an even better electrical connection.
Figure 6:
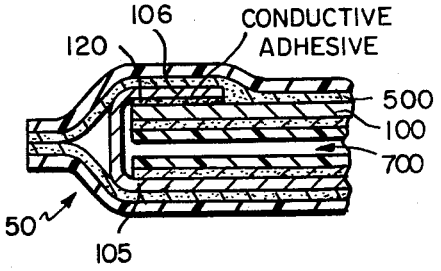
FIG. 6 is an view similar to FIG. 5 illustrating the use of an electrically conductive adhesive to effect a good electrical connection.

Reference should now be had to FIGS. 5 and 6 which show embodiments of the present invention which provide even more positive metal-metal contact between the foils 100 and 105. These figures are essentially the same as FIGS. 1 and 2 however in FIG. 5 a crimp (see arrow 115) is provided in the flanges 106 and 107 (see FIG. 5 in which 106 is shown) and in the top foil (member) 100 to effect a more positive contact and in FIG. 6 an electrically conductive adhesive 120 is positioned between the flanges 106 and 107 and the top foil 100. Electrical conductive adhesives which may be used include those sold by Chomerics, Inc. (Woburn, Mass.) as CHO-BOND ® conductive adhesives.

We claim:

1. A cable shielding device comprising a length of a first sheet of self supporting metal foil, said first sheet having longitudinal edge portions, a length of a second sheet of self-supporting metal foil of a width greater than said first sheet, said second sheet having longitudinal edges, portions of said second sheet forming flanges which are in electrical contact with said first sheet surface which it overlies, a first low friction surface coupled to the first sheet on the sheet side opposite the flange of the second sheet, a second low friction surface coupled to said second sheet on the sheet side closest the first low friction surface but not covering the flange portions of the second sheet in electrical contact with the first sheet, and an outer insulating cover surrounding said first and second sheets.

2. A cable shielding device as in claim 1 having a longitudinal crimp in said flanges and the first sheet underlying and in electrical contact with said flanges.

3. The device of claim 1 in which the metal foil is selected from copper and aluminum.

4. The device of claims 1 or 3 in which the low friction surfaces comprise polyester and the outer insulating cover comprises polyvinyl chloride or polyvinyl fluoride.

5. A cable shielding device comprising a length of a first sheet of self supporting metal foil, said first sheet having longitudinal edge portions, a length of a second sheet of self-supporting metal foil of a width greater than said first sheet, said second sheet having longitudinal edges, portions of said second sheet forming flanges which are in electrical contact with said first sheet surface which it overlies, a first low friction surface coupled to the first sheet on the sheet side opposite the flange of the second sheet, a second low friction surface coupled to said second sheet on the sheet side closest the first low friction surface but not covering the flange portions of the second sheet in electrical contact with the first sheet, and an outer insulating cover surrounding said first and second sheets, a portion of said cover being opened up and one of said flanges having a portion folded over upon itself so that an electrical connection may be made to the foil.

6. A cable shielding device comprising a length of a first sheet of self supporting metal foil, said first sheet having longitudinal edge portions, a length of a second sheet of self supporting metal foil of a width greater than said first sheet, said second sheet having longitudinal edges, portions of said second sheet forming flanges which are in electrical contact with said first sheet surface which it overlies, a first low friction surface coupled to the first sheet on the sheet side opposite the flange of the second sheet, a second low friction surface coupled to said second sheet on the sheet side closest the first low friction surface but not covering the flange portions of the second sheet in electrical contact with the first sheet, and an outer insulating cover surrounding said first and second sheets, and a metal wire extending from one end of the device, said metal wire positioned between one of said flanges and the underlying portion of said first sheet and in electrical contact with said first and second sheets.

* * * * *